United States Patent [19]

Holcombe et al.

[11] Patent Number: 5,006,306

[45] Date of Patent: Apr. 9, 1991

[54] PROCESS FOR ALLOYING URANIUM AND NIOBIUM

[75] Inventors: Cressie E. Holcombe, Farragut; Walter G. Northcutt, Jr., Oak Ridge; David R. Masters; Lloyd R. Chapman, both of Knoxville, all of Tenn.

[73] Assignee: The United States of America as represented by the United States Department of Energy, Washington, D.C.

[21] Appl. No.: 578,154

[22] Filed: Sep. 6, 1990

[51] Int. Cl.[5] ..... C22C 45/00

[52] U.S. Cl. ..... 420/3; 420/590; 146/132; 146/401

[58] Field of Search ..... 420/3, 590; 148/132, 148/401

[56] References Cited

U.S. PATENT DOCUMENTS 3,772,004 11/1973 Jackson ..... 148/132

4,493,737 1/1985 Banker ..... 148/131

*Primary Examiner*—Stephen J. Lechert, Jr.

*Attorney, Agent, or Firm*—Stephen D. Hamel; William R. Moser; Richard E. Constant

[57] ABSTRACT

Alloys such as U-6Nb are prepared by forming a stacked sandwich array of uraniun sheets and niobium powder disposed in layers between the sheets, heating the array in a vacuum induction melting furnace to a temperature such as to melt the uranium, holding the resulting mixture at a temperature above the melting point of uranium until the niobium dissolves in the uranium, and casting the uranium-niobium solution. Compositional uniformity in the alloy product is enabled by use of the sandwich structure of uranium sheets and niobium powder.

9 Claims, No Drawings

PROCESS FOR ALLOYING URANIUM AND NIOBIUM

FIELD OF THE INVENTION

This invention relates to processes for preparation of uranium-niobium alloys. The invention was made under contract No. DE-AC05-840R21400 between Martin Marietta Energy Systems, Inc., and the U.S. Department of Energy.

BACKGROUND OF THE INVENTION

Certain applications exist for uranium-base alloys containing small amounts of niobium, for example, U-6Nb. Alloys of this composition have proven difficult to prepare. Direct alloying as by combining plates or pieces of the metals and melting in a vacuum induction furnace has not been effective owing to a lack of compositional control in the resulting cast product. An expensive and inefficient double arc melting process has been used to obtain alloys of controlled composition. Another approach employed, where U-Nb alloy scrap is being recycled and combined with additional amounts of uranium and niobium, includes multiple steps of combining the U-6Nb alloy scrap with the stoichiometric amount of uranium required for producing a half-round bar slab of uranium-2 wt. % niobium alloy and melting the mixture by vacuum induction melting, stacking the resulting U-2Nb alloy bars with slabs of niobium metal into a sandwich-type electrode, arc melting the electrode, and arc melting a second time to form a billet of U-6Nb. This combination of double arc melting and vacuum induction heating produces a satisfactory product that makes use of recycled scrap but is unduly complicated and expensive. A simpler process that avoids such multiple steps and that avoids any need for arc melting would be highly advantageous over the previously used processes.

SUMMARY OF THE INVENTION

This invention is directed to a process for producing uranium-niobium alloys which comprises preparing a charge of stoichiometric quantities of uranium sheets and niobium powder in a sandwich-type array with the niobium powder positioned between uranium sheets, heating the array under vacuum or an inert atmosphere to melt the uranium and to dissolve the niobium powder in the molten uranium and casting the resulting uranium-niobium solution to form an alloy billet. This process provides a product having favorable compositional uniformity without requiring arc melting steps that are characterized by low efficiency and high expense. Induction melting equipment and less demanding process conditions may be used in carrying out the process, resulting in cost savings. Furthermore, only a single heating step is required.

Successful alloying of uranium with niobium in powder form was unexpected owing to a concern that the powder would be excessively oxidized owing to the high oxygen partial pressure at normal foundry operating conditions. Also, reaction of the niobium powder with oxide crucible coatings applied to a graphite crucible, or $CO_2$ gas produced therefrom, was expected, along with flotation problems due to the difference in density of niobium (8.4 g/cm$^3$) as compared to uranium (19.1 g/cm$^3$). For these reasons, niobium powder was considered a "last resort" after unsuccessful tests using niobium in the form of plates or turnings. We have found, however, that the expected oxidation of Nb powder is limited because the uranium melts at a significantly lower temperature than the Nb and the Nb is dissolved uniformly in the molten uranium. The sandwich-type structure of the alloying constituents is essential to obtaining the desired uniformity.

It is, therefore, an object of this invention to provide a process for preparing uranium-niobium alloys without use of arc melting.

Another object is to provide a process for preparing such alloys that may be carried out in vacuum induction melting equipment.

Still another object is to provide a process for preparing uranium-niobium alloys that requires only a single melting step.

Other objects and advantages of the invention will be apparent from the following description and the appended claims.

DESCRIPTION OF THE PREFERRED EMBODIMENT

In a preferred embodiment, uranium-niobium alloys, specifically U-6Nb, are prepared by forming a stacked sandwich array of uranium plates or sheets with niobium powder disposed between the plates or sheets, heating the array under a vacuum or an inert atmosphere so as to melt the sheets, allowing the niobium powder to dissolve in the molten uranium, and casting the resulting molten solution.

The uranium-niobium sandwich array is made up to provide a charge having stoichiometric quantities of the metals as required for the desired alloy. In general, a niobium content of about 2.0 to 7.5 wt. % may be used, with an alloy of particular interest containing 6.0 wt. %. Uranium plates or sheets in the stacked array may have a thickness such as ⅛ inch to ⅜ inch and are preferably cut to fit within and substantially cover the inner diameter of the crucible used for melting. The niobium powder may have a particle size of −200 mesh (75 microns), and a size of 25 to 75 microns is preferred. Heating of the sandwiched array to melt the uranium may be carried out in a suitable crucible in a vacuum induction furnace, with graphite being a preferred crucible material. Standard wash coats of yttrium or zirconium oxides may be used. A vacuum or atmosphere of a gas that is inert to the niobium and uranium under process conditions employed is provided to prevent undesired side reactions. For a graphite crucible, an atmosphere of argon may be used. Other inert gases such as helium may also be used. Heating to a temperature of 1,400° C. to 1,500° C. is required, with a temperature of approximately 1,425° C. being preferred. At the preferred temperature, holding for a period of 45 minutes is required for complete dissolution of the niobium powder in molten uranium.

The molten uranium-niobium solution may then be cast to form a billet or ingot by being poured into a mold of graphite wash coated with zirconium silicate, or zirconium or yttrium oxides, using the conventional techniques.

Properties of the uranium alloys prepared by the process of this invention fall within established nominal limits in terms of impurity content, compositional uniformity, and physical properties.

The invention is further illustrated by the following examples.

EXAMPLE 1

In an operation of the subject process, 0.2 kilogram of niobium powder having a particle size less than 44 microns was spread between two sheets of uranium in a crucible. The total weight of the uranium sheets was 9.8 kilograms. The uranium in the sandwich-type structure was heated in a vacuum atmosphere and at temperatures ranging from 1,200° to 1,250° C. for 30 minutes in a vacuum induction furnace; then the temperature of the furnace was increased to 1,500° C. and held for 60 minutes. The uranium sheets were melted, and the niobium powder was dissolved in the molten uranium in the two heating operations. The molten uranium-niobium alloy was poured into a billet having a height of 6.8 centimeters.

Chemical analyses of the billet indicated that the total niobium content was 1.97 wt. %, of which the bottom section contained 1.90 wt. %, the middle sections contained 2.00 wt. %, and the top section contained 2.00 wt. %. These analyses indicated that the niobium uniformity was nominal for a billet of uranium-2 wt. % niobium alloy. Other chemical analyses indicated that the billet of uranium niobium alloy contained 61 ppm of carbon, less than 1 ppm of yttrium, 42 ppm of aluminum, 78 ppm of silicon, and less than 1 ppm of zirconium. These analyses indicated that the billet contained no more than the nominal amounts of impurities.

EXAMPLE 2

In another operation of the subject process, 0.37 kilogram of niobium powder having a particle size less than 44 microns was spread between plates of U-Nb alloy weighting 8.66 kilograms and having a niobium content of 1.85 wt. %. The total weight of the sandwich-type structure was 9.0 kilograms. The sandwich-type structure was prepared in a ceramic crucible and loaded into a vacuum induction furnace. The furnace was evacuated, then heated to a temperature range of 1,200° to 1,250° C. and held for 30 minutes in the vacuum environment and within this temperature range. The temperature of the furnace was increased to 1,500° C. and held for 60 minutes in the vacuum environment. The plates of U-Nb alloy were melted, and the niobium powder was dissolved in the U-Nb alloy. The molten U-Nb alloy was poured into a billet having a height of 6.7 centimeters.

Chemical analyses of the billet indicated that the total niobium content was 5.54 wt. %, of which the bottom section contained 5.21 wt. %, the middle section contained 5.63 wt. %, and the top section contained 5.71 wt. %. These niobium contents and the niobium distribution are nominal for U-6Nb alloy.

Other chemical analyses indicated a carbon content of 89 wppm, an aluminum content of 12 wppm, a silicon content of 87 wppm, and the yttrium and zirconium contents were less than 1 wppm. These analyses indicated that the billet contained the nominal amount of impurities.

EXAMPLE 3

In a large scale example of the subject process, 30 kilograms of niobium powder of particle size less than 74 microns was spread over several ¼-inch thick plates of uranium metal weighting a total of 460 kilograms, utilizing the sandwich-type arrangement and a yttrium-oxide-wash coated graphite crucible. The charge was vacuum melted at 1,425° C. and held 45 minutes at that temperature, after which the alloy was cast into a zirconium-silicate-wash coated mold. The casting was a log approximately 6 inches in diameter X 60 inches long. Chemical analyses of the casting revealed that the nominal U-6Nb alloy composition was obtained with impurity levels within normal ranges for uranium castings:

Nb:6.3±0.9 wt. %

C:100 wppm

The above examples are merely illustrative and not to be understood as limiting the scope of the invention, which is limited only as indicated by the appended claims.

We claim:

1. A process for preparing uranium-base alloys containing a small amount of niobium which comprises:
   - forming a stacked array of uranium plates or sheets having niobium powder disposed in layers between said sheets, the relative amounts of uranium and niobium being selected to provide a stoichiometric amount for a desired alloy composition;
   - heating said array in a crucible under a vacuum or inert atmosphere to a temperature such as to melt the uranium;
   - holding the resulting molten uranium-niobium powder mixture at a temperature such as to maintain the uranium in molten state until the niobium powder dissolves therein; and
   - casting the resulting uranium-niobium solution.

2. The process as defined in claim 1 wherein said desired alloy composition is U-2Nb to U-7.5Nb.

3. The process as defined in claim 2 wherein said desired alloy composition is U-6Nb.

4. The process as defined in claim 2 wherein said niobium powder has an average particle size of 25 to 75 microns.

5. The process as defined in claim 2 wherein said stacked array is heated to a temperature of 1,400° C. to 1,500° C. to melt the uranium.

6. The process as defined in claim 5 wherein said molten uranium-niobium powder mixture is held at a temperature of at least 1,425° C. for a period of at least 45 minutes to dissolve said niobium.

7. The process as defined in claim 2 wherein said uranium sheets have a thickness of ⅛ to ⅜ inch.

8. The process as defined in claim 2 wherein said crucible comprises a graphite crucible.

9. The process as defined in claim 2 wherein said array is heated under vacuum in a vacuum induction melting furnace.

* * * * *